United States Patent [19]

Kackstädter et al.

[11] 4,047,887

[45] Sept. 13, 1977

[54] WHITENING OF POLYESTER FIBERS

[75] Inventors: Klaus Kackstädter; Hans Theidel, both of Leverkusen, Germany

[73] Assignee: Bayer Aktiengesellschaft, Leverkusen, Germany

[21] Appl. No.: 570,408

[22] Filed: Apr. 22, 1975

[30] Foreign Application Priority Data

Apr. 27, 1974 Germany ..... 2420473

[51] Int. Cl.[2] ..... D06P 5/20

[52] U.S. Cl. ..... 8/1 W; 8/21 C; 8/179; 252/301.21; 542/457; 542/400; 542/429

[58] Field of Search ..... 8/1 W; 252/301.21, 301 WT; 260/240 R, 240.9, 240 D

[56] References Cited

U.S. PATENT DOCUMENTS

| | | | |
|---|---|---|---|
| 3,066,005 | 11/1962 | Wedemeyer et al. | 8/54.2 |
| 3,255,232 | 6/1966 | Cohen | 260/465 |
| 3,347,617 | 10/1967 | Ulrich et al. | 8/42 |

*Primary Examiner*—Joseph L. Schofer
*Assistant Examiner*—A. L. Clingman
*Attorney, Agent, or Firm*—Plumley and Tyner

[57] ABSTRACT

Process for the whitening of polyester fibers or mixed fibers of polyesters and cellulose with dispersion fluorescence whitening agents by the pad-thermosol process in the presence of a water-soluble alkali methal tetraborate, alkali metal silicate, alkali metal aluminium sulphate, alkali metal polyphosphate or alkali metal sulphate.

5 Claims, No Drawings

WHITENING OF POLYESTER FIBERS

The subject of the invention is a process for the whitening of polyester fibres or mixed fibres of polyesters and cellulose with dispersion fluorescence whitening agents (= FWA) by the pad-thermosol process in the presence of a water-soluble alkali methal tetraborate, alkali metal silicate, alkali metal aluminium sulphate, alkali metal polyphosphate or alkali metal sulphate. Salts of the formulae $$Me_2B_4O_7,\ Me_2SiO_3,\ Me_2Si\ _2O_5,\ MeAl(SO_4)_2,\ Me_{m+2}P_mO_{3m+1},\ Me_nP_nO_{3n},\ \text{or}\ Me_2SO_4,$$

in which

*m* denotes 2–$10^6$ and

*n* denotes 3–8 and

Me preferably represents sodium or potassium, are preferred.

These salts can contain water of crystallisation.

Alkali metal salts of the polyphosphoric acids, which are described, for example, in K. Lindner "Tenside, Textilhilfsmittel, Waschrohstoffe" ("Surface-active Agents, Textile Auxiliaries and Raw Materials for Washing Agents"), volume II, 1964, page 1,171 et seq. are particularly preferred.

Examples of polyester fibres to be treated in accordance with the process according to the invention are those which are described in the fibre tables of P. A. Koch "Textilveredlung", September 1973, page 435 et seq.

Examples of the dispersion FWA's are described, for instance, in British Patent Specifications Nos. 1,201,759, 1,225,224 and 1,313,253 and U.S. Pat. No. 3,758,460.

Dispersion FWA's of the coumarin and styryl series are preferred, above all coumarin derivatives which are substituted in the 3-position by pyrazolyl or 1,2,4-triazolyl radicals and in the 7-position by 1,2,5-triazolyl radicals.

The alkali metal salts to be used in accordance with the invention can be added to the FWA dispersion or to the padding liquor.

A further subject of the invention are agents for whitening polyester fibres or mixed fibres of polyesters and cellulose by the pad-thermosol process, which contain a water-soluble inorganic salt of the formulae $$Me_2B_4O_7,\ Me_2SiO_35\ Me_2Si_2O_5,\ MeAl(SO_4)_2,\ Me_{m+2}P_mO_{3m+1},\ Me_nP_nO_{3n},\ \text{or}\ Me_2SO_4,$$

in which

*m* denotes 2–$10^6$ and

*n* denotes 3–8 and

Me preferably represents sodium or potassium, and which can contain water of crystallisation, the salt preferably being present in an amount of 150–200 g per kg of FWA dispersion. The agents preferably contain 60–250 g/kg of the FWA.

To prepare the padding liquors, 10–25 parts by weight of this dispersion are diluted with 990–975 parts by weight of water.

The padding liquors and the abovementioned agents can optionally contain, in addition to the FWA's and the salts to be used according to the invention, commercially available dispersing agents, such as oleyl polyglycol ethers, for example with 50 ethylene oxide units, and/or condensation products of formaldehyde and a diaryl-ether-sulphonic acid, for example diphenyl-ether-monosulphonic acid.

The process is usually carried out by impregnating the textile materials with the FWA liquors which contain the salts to be used according to the invention, squeezing them off to a liquor pick-up of about 70–100%, drying them and then fixing the FWA to the textile materials by heating for about 20 seconds to 150°–230° C, preferably 160°–190° C.

The amounts in which the alkali metal salts to be used according to the invention must be present in the padding liquors to achieve an optimum effect can easily be determined by preliminary experiments; in general, 1–4 g, preferably 2 g, per liter of padding liquor have proved successful when working with 70–100% liquor pick-up.

By adding the alkali metal salts to be used according to the invention, the maximum whitening effect is increased considerably compared to that achievable with the dispersion FWA's without this additive. An increase in the degree of whiteness of about 30–40% is achieved (calculated according to A. Berger; compare "Die Farbe", volume 8, 1959, issue 4–6).

Furthermore, an addition of the salts makes it possible to lower the thermosol treatment temperature required to achieve an optimum whitening. The increase in maximum whiteness is particularly advantageous in the case of those whiteners with which, in the absence of the alkali metal salts to be used according to the invention, an optimum whitening degree is only achieved at high thermosol treatment temperatures, for example at 210°–220° C.

EXAMPLE 1

A knitted fabric, ready for colour treatment, of texturised polyethylene glycol terephthalate fibres is impregnated completely, by dipping at approx. 25° C, with an aqueous dispersion which has been prepared in accordance with the recipe described below, and is squeezed off between the rolls of a padder until it only retains approx. 90% — of its dry weight — of padding liquor. This knitted fabric is then dried for 30 seconds at approx. 140° C and is thereafter thermofixed for 20 seconds by means of hot air at 175° C. The whiteness is very brilliant and intense, and very resistant to light, wet processing and chlorite.

The colorimetrically determined degree of whiteness (according to Berger) is approx. 30% higher than in the case of an otherwise similarly produced whitening using a corresponding aqueous FWA dispersion which does not contain the salt according to the invention.

The dispersion used can be prepared as follows: 30 parts of the FWA of the formula

A

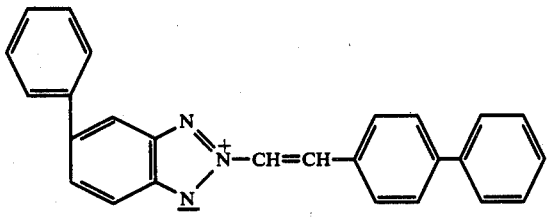

are mixed with 5 parts of an oleyl polyglycol ether and 65 parts of water. This mixture is finely ground on a bead mill until about half of all the particles are of size 0.5–1μ. 24 parts of the mixture are then diluted with 30 parts of the said oleyl polyglycol ether, 2 parts of a dispersing agent of the type of a condensation product of a diaryl-ether-monosulphonic acid and formaldehyde, and 58 parts of water and a solution of 34 parts of water and 20 parts of sodium hexametaphosphate. 12 parts by weight of this dispersion are diluted with 988 parts by weight of water to produce the padding liquor used.

A comparably good whitening effect is achieved if sodium tripolyphosphate, sodium tetraborate or a water-soluble sodium silicate is employed instead of the sodium-hexametaphosphate.

Instead of the FWA of the formula A, the FWA's B, C or D can also be employed with good result.

B

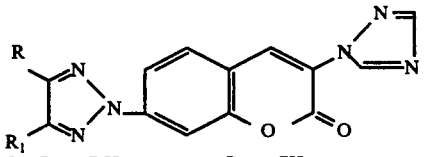

$B_1$ : R = $C_6H_5$, $R_1$ = $CH_3$
$B_2$ : R = $C_2H_5$, $R_1$ = $CH_3$
$B_3$ : R = $COOC_2H_5$, $R_1$ = $C_6H_5$
$B_4$ : R = H, $R_1$ = NH—CO—$CH_3$

C

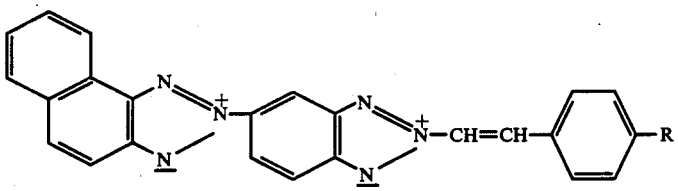

R = H, $CH_3$, $C_2H_5$, $CH_3$—O, $C_2H_5$—O

D

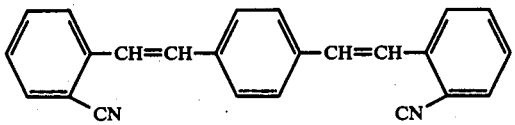

EXAMPLE 2

A knitted fabric, ready for colour treatment, of texturised polyethylene glycol terephthalate fibres is impregnated, by dipping at approx. 25° C, with an aqueous dispersion which contains 0.7 g/l of the whitener of the formula

E

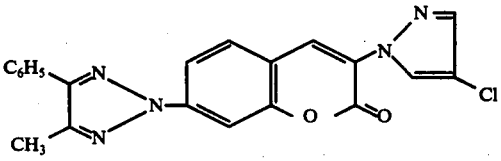

and 2 g/l of sodium hexametaphosphate.

The textile material treated in this way is squeezed off between the rolls of a padder until it only retains approx. 90%—of its dry weight—of padding liquor. Thereafter, this fabric is dried for 30 seconds at 140° C and is then thermofixed for 20 seconds at 175° C by a treatment with hot air. The whiteness of this textile material is intense, very brilliant and very resistant to light, wet processing and chlorite. The colorimetrically determined degree of whiteness (according to Berger) is approx. 40% higher than in the case of a whitening produced under otherwise similar conditions, but without addition of sodium hexametaphosphate.

A comparably good whitening effect is achieved if potassium aluminium sulphate is employed instead of the phosphate.

Instead of the FWA of the formula E, the FWA of the formula

F

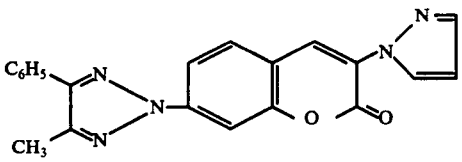

can also be employed successfully.

EXAMPLE 3

A woven fabric, ready for colour treatment, of 67 parts of polyethylene glycol terephthalate fibres and 33 parts of cotton is completely impregnated, by dipping at approx. 25° C, with an aqueous dispersion which contains 0.6 g/l of the FWA of the formula $B_1$ and to which 2 g/l of sodium hexametaphosphate have been added. The textile material treated in this way is squeezed off between the rolls of a padder until it only retains approx. 70% — of its dry weight — of padding liquor. Thereafter, this fabric is dried at 140° C for 30 seconds and then thermofixed for 20 seconds at 200° C by a treatment with hot air. The whiteness of this textile material is intense, very brilliant, and very resistant to light and wet processing.

The colorimetrically determined degree of whiteness (according to Berger) is 135.57 as compared to 131.63 in the case of a whitening carried out under otherwise identical conditions but without addition of sodium hexametaphosphate.

We claim:

1. In the process for whitening polyester materials or mixed fibres of polyester and cellulose with a dispersion of a fluorescent coumarin or styryl whitening agent by the pad-thermosol process, the improvement comprising using said fluorescent whitening agent in a liquor also containing 1 to 4 g/l of a water-soluble inorganic salt from the group of alkali metal tetraborate, alkali metal silicate, alkali metal aluminum sulphate, alkali metal polyphosphate or alkali metal sulphate.

2. Process of claim 1 in which a sodium salt of a polyphosphoric acid is used as the water-soluble inorganic salt.

3. Process of claim 1 in which a fluorescent whitening agent having the formula A, $B_1$, $B_2$, $B_3$, $B_4$, C, D, E or F

A

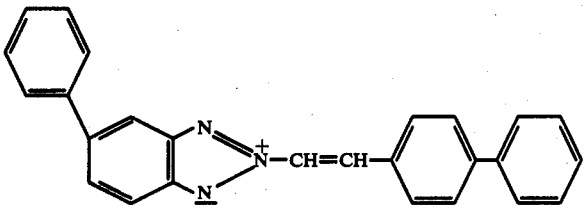

B

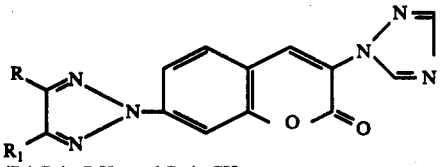

($B_1$) R is $C_6H_5$, and $R_1$ is $CH_3$;
($B_2$) R is $C_2H_5$, and $R_1$ is $CH_3$;
($B_3$) R is $COOC_2H_5$ and $R_1$ is $C_6H_5$;
($B_4$) R is H, and $R_1$ is NH—CO—$CH_3$;

C

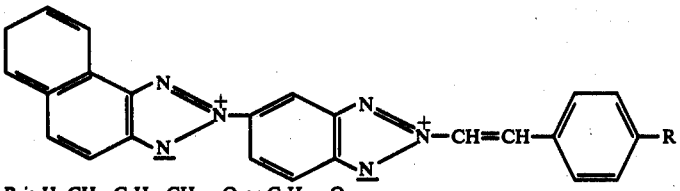

R is H, $CH_3$, $C_2H_5$, $CH_3$—O or $C_2H_5$—O;

D

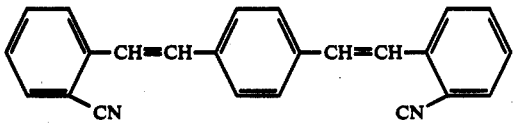

E

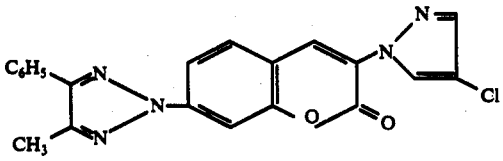

F

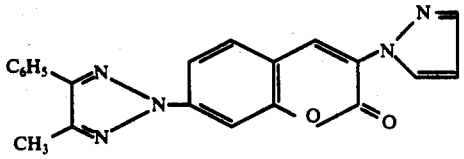

is used.

4. Process of claim 1 in which a compound of the formula $$Me_2B_4O_7,\quad Me_2SiO_3,\quad Me_2Si_2O_5,\quad MeAl(SO_4)_2,\quad Me_{m+2}P_mO_{3m+1},\ Me_nP_nO_{3n},\ \text{or}\ Me_2SO_4,$$

wherein $m$ is $2-10^6$;

$n$ is 3–8; and

Me sodium or potassium; is used as the water-soluble inorganic salt.

5. A composition of matter comprising a dispersion containing 60–250 g/kg. of fluorescent coumarin or styryl whitening agent and 150–200 g/kg of a water soluble inorganic salt of the formula $$Me_2B_4O_7,\quad Me_2SiO_3,\quad Me_2Si_2O_5,\quad MeAl(SO_4)_2,\quad Me_{m+2}P_mO_{3m+1},\ Me_nP_nO_{3n},\ \text{or}\ Me_2SO_4$$

in which $m$ is $2-10^6$;

$n$ is 3–8; and

Me is sodium or potassium.

* * * * *